United States Patent [19]

Perkins

[11] Patent Number: 4,689,727

[45] Date of Patent: Aug. 25, 1987

[54] DECORATIVE OIL LAMP

[75] Inventor: David R. Perkins, Manchester, Mass.

[73] Assignee: Glass Dimensions, Inc., Essex, Mass.

[21] Appl. No.: 896,592

[22] Filed: Aug. 14, 1986

[51] Int. Cl.[4] ..... F21L 19/00

[52] U.S. Cl. ..... 362/161; 431/320; 431/323

[58] Field of Search ..... 362/161, 101, 163; 431/288, 320, 323

[56] References Cited

U.S. PATENT DOCUMENTS

| | | | |
|---|---|---|---|
| 653,617 | 7/1900 | Climenson | 362/161 |
| 1,027,285 | 5/1912 | Schwager | 362/161 |
| 1,249,668 | 12/1917 | Putnam | 431/323 |
| 4,035,138 | 7/1977 | Walters | 431/320 |

*Primary Examiner*—Douglas Hart

*Attorney, Agent, or Firm*—Cesari and McKenna

[57] ABSTRACT

A decorative oil lamp comprises an enclosure formed by a pair of oppositely dished plates, the lower plate being reflective and the upper plate being transparent. An opening is present in the upper plate in which is supported a wick assembly consisting of a vertical tube and a wick therein whose lower end is immersed in oil present in the enclosure. When the upper end of the wick is lit, the reflective lower plate projects light from the flame upward and reflects the wick assembly so that it appears to be burning at both ends.

6 Claims, 4 Drawing Figures

DECORATIVE OIL LAMP

This invention relates to lamps. It relates more particularly to a decorative oil lamp.

BACKGROUND OF THE INVENTION

Numerous oil lamps have been developed over the years which not only provide illumination, but also constitute table decorations or ornaments. Examples of such lamps are disclosed in U.S. Pat. Des. No. 281,279 and 4,399,494. Usually the lamp container or housing performs a decorative function. In some instances, however, the flame burning on the lamp's wick constitutes an integral part of the decoration, as shown in the latter patent above. The present invention concerns a lamp of this general type which extends or expands the decorative bounds of the lamp and its flame.

SUMMARY OF THE INVENTION

My lamp comprises a pair of upper and lower dished plates which are secured at their peripheries to define an enclosure shaped like a flying saucer. The enclosure is supported in a generally horizontal plane by legs depending from the lower plate. Also, the undersurface of that lower plate is covered with a reflective coating which reflects light from above the lamp back up through the lower plate. The upper plate comprising the enclosure is transparent and a hole is present at the center of that plate so that the space between the two plates can be partially filled with a transparent flammable oil.

A wick assembly comprising of a transparent glass tube with a length of wick therein is suspended vertically in that hole so that the lower end of the wick is immersed in the oil and the upper end of the wick projects from the tube above the enclosure. When the lamp is lit, the flame is projected by the reflective lower plate onto the ceiling of the room in which the lamp is located.

Also, when an observer looks down through the transparent top wall of the enclosure, due to the dished reflective lower plate, the wick assembly appears to be burning at both ends. This coaction between the lamp components and the flame produced thereby produce an overall decorative or design effect which is particularly pleasing to the eye.

The hole in the lamp upper plate is quite small so that there is little danger of oil spillage and oil evaporation is held to minimum. Also the wick assembly is easily removable from the enclosure in order to replace the wick or adjust its height for optimal flame size and/or maximum design effect.

BRIEF DESCRIPTION OF THE DRAWING

For a fuller understanding of the nature and objects of the invention reference should be had to the following detailed description, taken in connection with the accompanying drawing, in which.

DETAILED DESCRIPTION OF THE PREFERRED EMBODIMENT

Figure 1:
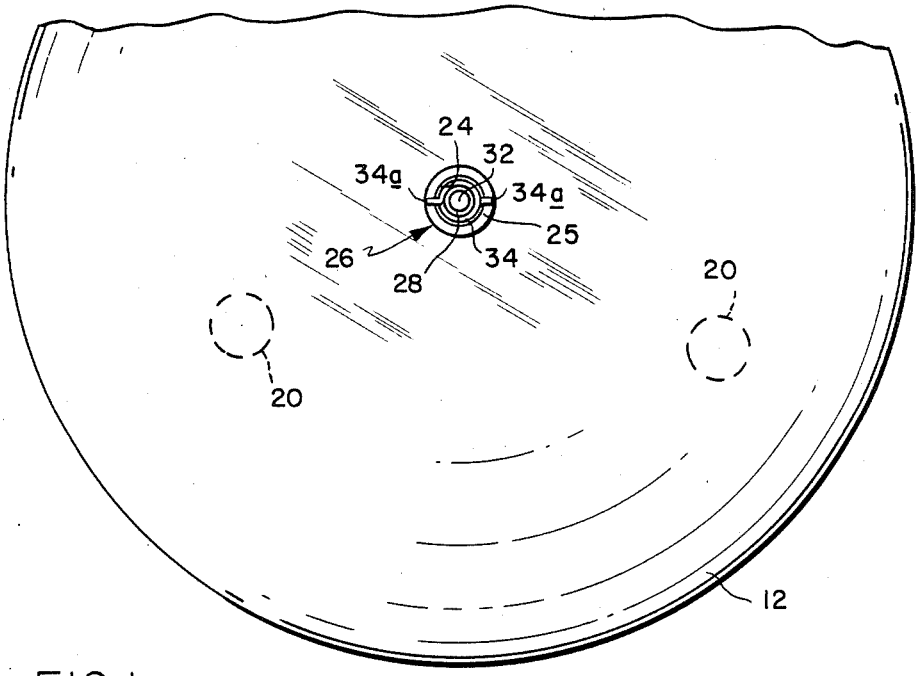
FIG. 1 is a top plan view of a decorative oil lamp embodying the features of my invention.
Figure 2:
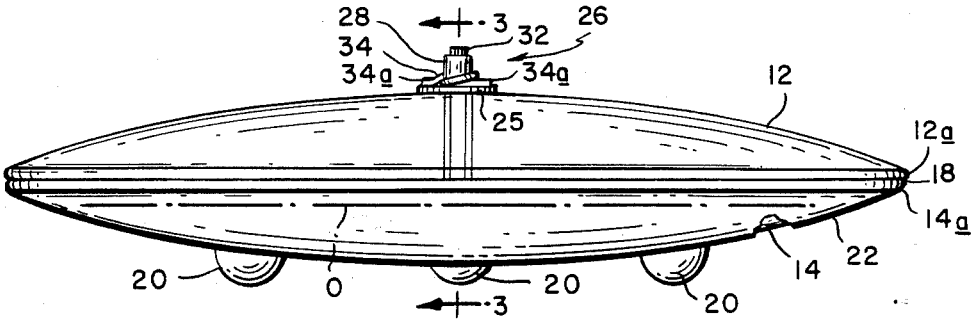
FIG. 2 is a side elevational view thereof.

Referring to the drawing FIGS. 1 and 2, my lamp indicated generally at 10 comprises an upper circular dished plate 12 and a lower circular dished plate 14. Preferably, both have spherical curvature. The two plates have substantially the same diameter and they are juxtaposed so that their respective peripheries or edges 12*a* and 14*a* contact one another to form a saucer-like lamp housing or enclosure 16 as best seen in FIG. 2. The two plates are permanently secured together at their edges by a fusion seam 18 which extends all around the enclosure. A plurality, herein three, feet 20 are mounted to the underside of plate 14 to support lamp 10 in a horizontal plane as shown. In the illustrated lamp, feet 20 comprise three soft plastic hemispheres adhered to the underside of plate 14. However, it should be understood that a stand or other equivalent support means may be used to stabilize the lamp.

Figure 3:
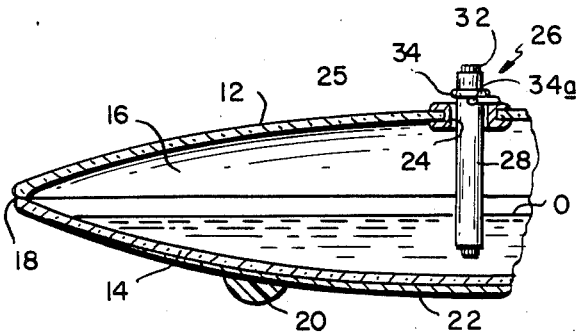
FIG. 3 is a fragmentary sectional view of the lamp.

As best seen in FIG. 3, the lower plate 14 is made reflective by applying to the undersurface of that plate a metal film or coating 22 which is upwardly reflective. In other words, the lower plate 14 constitutes a spherical mirror which reflects light incident on its upper concave surface. Coating 22 may be applied to plate 14 in the same manner as the aluminum or silver films or coatings are applied to conventional mirrors. Less preferably, plate 14 can be made reflective by adhering metal foil to the upper surface of that plate.

Referring to FIGS. 1–3, the upper plate 12 is transparent to incident light. It may be clear or it may be colored. A relatively small hole 24 is formed in plate 12 at the very center of the plate. Situated in hole 24 is a wick assembly shown generally at 26. That wick assembly includes a short length of glass tubing 28 in which is frictionally supported a length of wick 32. The wick is somewhat longer than the length of the tube so that the wick ends project from the opposite ends of that tube. Tube 28 is held in a vertical position within hole 24 by a metal bracket 34. This bracket is simply a wire strand wrapped around tube 28 with the strand ends 34*a* extending out on diametrically opposite sides of the tube beyond the wall of the plate opening 24. The bracket is slidably positioned near the upper end of the tube so that the tube hangs down vertically into the lamp enclosure 16 with the lower ends of the tube and wick being situated near lower plate 14 as best seen in FIG. 3.

The lamp 10 is filled with flammable oil by removing the wick assembly 26 and pouring oil into the lamp enclosure 16 through opening 24, using a suitable small funnel. Preferably the oil used in the lamp is optically clear and the lamp enclosure is filled to a level that is slightly below the plate seam 18 as shown at O in FIGS. 1 and 3. This oil level is such that when the wick assembly 26 is positioned in the enclosure as shown in FIG. 3, the lower ends of the tube 28 and wick 32 are well below the surface of the oil. Consequently, when the protruding upper end of the wick 32 is lit, a flame F will burn there for a long period of time until the level of the oil O in enclosure 16 falls below the lower end of the wick. The distance between the flame F and the lower plate 14 may be adjusted by sliding the wire strand 34 along tube 28. This adjusts the position of the flame relative to the focal point of that mirror structure.

Since the oil is completely contained within enclosure 16 and there is only a relatively small annular clearance space between tube 28 and the wall of opening 24, there is relatively little oil loss through evaporation. Accordingly, the subject lamp can burn continuously for several hours without requiring an oil refill. For the same reason, there is little danger of oil spilling from the lamp even if the lamp should be shaken or moved. Yet the tube 28 can be removed easily from enclosure 16 when it is necessary to replace wick 32 or to reposition it in tube 28 in order to make the lamp flame larger or smaller.

Figure 4:
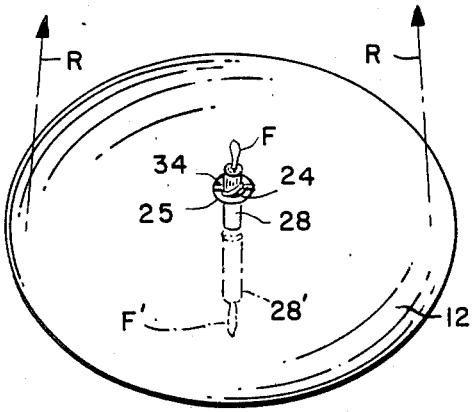
FIG. 4 is a bottom plan view thereof.

Referring now to FIG. 4, the wick assembly 26 and hence the flame F are located on the focal axis of the dished reflective plate 14. The spherical curvature of plate 14 and the spacing of the flame F from that plate are such that when the lamp is lit as shown in FIG. 4, the light from flame F is reflected or projected by that plate 14 in the direction of the arrows R onto the ceiling of the room in which the lamp 10 is located. Depending on the color of plate 12, that reflected light may be white or colored. This produces an illuminated area or cirle of light on the usually white ceiling which flickers, shimmers and dances due to movements of the flame F. That light reflected from the ceiling produces indirect light at the location of the lamp, adding illumination there. Also, that flickering lighted area on the ceiling produces a pleasing design effect in an otherwise darkened room.

Further, when the lamp 10 is viewed by an observer from a direction lying appreciably above seam 16, as in FIG. 4, a reflection 28' of the tube 28 produced by coating 22 is visible to the observer which is inverted and extends down into the enclosure 16, being terminated at it lower end by a flame image F'. The effect produced then is one of a candle or taper burning at both ends. This second visual effect produced by the lamp cooperates with the ceiling reflection described above to make the lamp and its surroundings especially visually attractive.

The focal length, i.e., curvature, of the reflective plate 14 and the spacing of the upper end of the wick 32 above plate 14 may be varied depending upon the size of the ceiling spot desired. It has been found that a plate diameter and curvature in the order of six and twelve inches respectively and a flame F spacing above the center of plate 14 of 1–2 inches produce a ceiling spot of appropriate size and diffuseness.

It will thus be seen that the objects set forth above, among those made apparent from the preceding description, are efficiently attained and, since certain changes may be made in the above construction without departing from the scope of the invention, it is intended that all matter contained in the above description or shown in the accompanying drawing be interpreted as illustrative and not in a limiting sense.

It is also to be understood that the following claims are intended to cover all of the generic and specific features of the invention herein described.

What is claimed as new and desired to be secured by Letters Patent of the United States is:

1. A decorative oil lamp comprising

A. an enclosure having a dished transparent upper wall and a downwardly dished reflective lower wall which reflects light incident on the lower wall through the transparent upper wall;

B. a removable wick assembly including a wick extending down into said enclosure through said upper wall, said wick having an upper end spaced above said enclosure and a lower end positioned adjacent the bottom of said enclosure; and C. means for introducing flammable oil into said enclosure to support a flame at the upper end of said wick whose light is reflected by said lower wall upward away from the lamp.

2. The lamp defined in claim 1 wherein said enclosure upper and lower walls comprise A. a pair of oppositely dished circular plates; and B. means for connecting said plates together at their peripheries.

3. The lamp defined in claim 2 wherein said lower plate is an upwardly reflecting spherical mirror.

4. The lamp is defined in claim 2 wherein the upper plate is colored.

5. The lamp defined in claim 1 wherein said oil introducing means comprise A. means defining a hole at the center of said upper wall; and B. said wick assembly includes 1. a transparent tube encircling said wick and extending down into said enclosure through said hole; and
2. means for removably supporting said tube in said hole.

6. The lamp defined in claim 4 wherein said supporting means include a wire strand encircling said tube with the ends of the strand extending out laterally from the tube so as to overlie the edge of said hole.

* * * * *